United States Patent [19]

Korr et al.

[11] 3,953,690

[45] Apr. 27, 1976

[54] HIGH-CURRENT HIGH VOLTAGE SWITCH WITH INCISOR ELECTRODE

[75] Inventors: Heinrich Korr, Aachen, Germany; Douwe Maas, Hilversum, Netherlands; Gerhard Telemann, Julich, Germany

[73] Assignee: Kernforschungesanlage Jülich Gesellschaft mit beschränkter Haftung, Julich, Germany

[22] Filed: Mar. 13, 1975

[21] Appl. No.: 558,070

[30] Foreign Application Priority Data

Mar. 14, 1974 Germany ..... 2412261

[52] U.S. Cl. ..... 200/61.08

[51] Int. Cl.[2] ..... H01H 39/00

[58] Field of Search ..... 200/61.08; 337/19

[56] References Cited

UNITED STATES PATENTS 3,641,289 2/1972 Dokopoulos ..... 200/61.08

*Primary Examiner*—James R. Scott

*Attorney, Agent, or Firm*—Karl F. Ross; Herbert Dubno

[57] ABSTRACT

A rapid-action switch, especially for the switching of high voltages and currents in plasma physics, magnetohydrodynamics and like technologies in which an explosive force is provided through a consumable electrode within a U-shaped aluminum body separated from a switching electrode and sandwiched between this electrode and a counterelectrode constituting an anvil. An insulating layer between the proximal leg of the aluminum U and a sharp edge on the switching electrode is pierced as this leg is deformed by the explosive to bring the edge into contact with the U and thereby close the circuit. The switching electrode is provided with a channel open in the direction of the aluminum U and separated therefrom by the insulating layer, the channel having a mouth which is narrower than its base and being provided with a continuous prismatic bar extending over the entire width of the U-shaped aluminum body.

5 Claims, 4 Drawing Figures

HIGH-CURRENT HIGH VOLTAGE SWITCH WITH INCISOR ELECTRODE

The present invention relates to improvements in high-speed switches of the high-current and high-voltage type described in the commonly owned U.S. Pat. No. 3,641,289 issued Feb. 8, 1972.

BACKGROUND OF THE INVENTION

In the aforementioned patent, there is described a rapid-closing switch, especially for electrical circuits operating with voltages above 1000 volts and currents above 1000 amperes and in which, between the electrodes, there is disposed a U-shaped aluminum body which is replaceable and separated from at least one of the electrodes by a foil of insulating material. The switching electrode is juxtaposed with the counterelectrode and has sharp edges adapted to pierce the foil. Between the shanks of the U, there is provided an impulse source capable of being exploded, e.g. a fusible strip or a pair of closely spaced fusible strips, which can be connected to a source of electrical energy to generate the explosive or shock wave. Metal foils are closely spaced and are of equal spacing from the electrodes so that, upon explosive disintegration of the foils, the aluminum shanks of sheet metal of the U-shaped body are driven outwardly toward the switching and counterelectrodes. By rupture of the insulating foil, the aluminum body is driven against the switching electrode and brought into contact therewith.

As discussed in the aforementioned patent, each of the two metal foils is connected to an electrical-pulse source of high voltage and has a monotonically increasing cross section from its explosion-initiating part towards its connection with the source.

One of the improvements described in said patent resides in a groove formed in the switching electrode and open in the direction of the U-shaped body, this groove having a mouth whose width is narrower than the width of the base of the groove and receiving in the groove prismatic bars or ribs.

While the system described in this U.S. Pat. No. 3,641,289 has proved to be a major advance over the earlier arrangements, it has been found that the particular configuration of the bars in the grooves, with their transverse and longitudinal portions, have limited useful life and the breakdown voltage of the system under static conditions is low.

OBJECT OF THE INVENTION

It is the principal object of the present invention, therefore, to provide a rapid-action switch of the type described in the aforementioned patent but improved so as to have increased life, a higher static breakdown voltage, more rapid switching and a more readily reproducible switching operation.

SUMMARY OF THE INVENTION

According to the invention, the switch of U.S. Pat. No. 3,641,289, otherwise identical to the system described in said patent, is improved by substituting for the ribs contained in the groove of the switching electrode, a single prismatic bar or rib, converging to a sharp edge in the direction of the U-shaped body and received in the aforementioned groove and extending only in the longitudinal direction thereof.

Since the sole rib or bar of the present invention replaces the formations of the patent, it is free from the numerous corners and edges of the ribs of the prior system which have been found to reduce the breakdown voltage of the switch below necessary levels. Surprisingly, the present system allows the switch to be used for voltages across the electrodes in excess of 40 kilovolts with practically no static breakdown.

According to the invention, the switching electrode has a length which exceeds that of the replaceable U-section body whose width, measured parallel to the longitudinal direction of the groove, is less than that of the groove. The prismatic bar or rib according to the invention then has a length which corresponds to the width of the shank of the U-shaped aluminum sheet juxtaposed with the switching electrode. This has also been found to be required for an unobjectionable explosive deformation of the aluminum member and improved switching speed.

According to another feature of the invention, those portions of the groove which extend beyond the bar, i.e. those portions which project in either direction beyond the length of the prismatic bar, receive filler bodies of unhardened steel which flank the bar. These filler bodies may be attached to the bar and can be replaced therewith. The bar itself may be composed of hardened steel while the filler bodies which conform in configuration to that of the groove, need not be of hardened steel as noted, while the balance of the switching electrode may also be of unhardened steel or some high conductive material. This has been found to stabilize the switching process and permits the switch to be manufactured at low cost.

BRIEF DESCRIPTION OF THE DRAWING

The above and other objects, features and advantages of the present invention will be more readily apparent from the following description, reference being made to the accompanying drawing in which.

SPECIFIC DESCRIPTION

Figure 1:
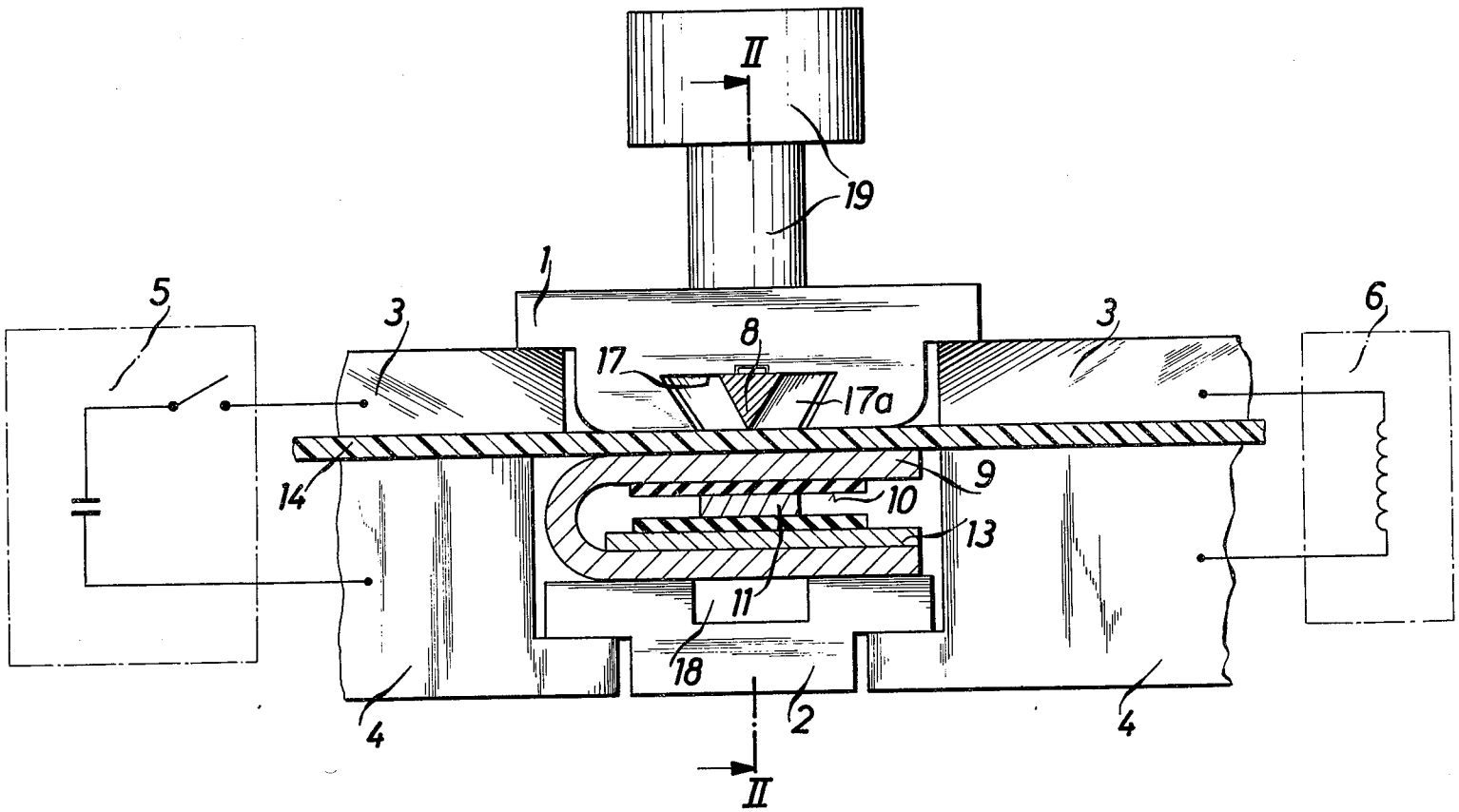
FIG. 1 is a side-elevational view of a switch according to the invention, partly in section.

Since the switch described below, except for the modifications specifically discussed, is identical to that of U.S. Pat. No. 3,641,289 in all particulars, reference is made to that patent for details as to the mode of operation and the structure to the extent that the same may not be elucidated below.

In the drawing, we show a rapid-acting switch which is especially suitable for the switching of high voltages and currents in plasma physics, magnetohydrodynamics, for the control of magnetic or electrical fields, for the production of these fields and for the creation of electrode discharges and, therefore, for the production, control or confinement of ionized gases of high potential energies.

The apparatus comprises a switching electrode 1 provided with a busbar 3 and a counterelectrode 2 provided with a busbar 4, the electrodes being connected by the busbars so that, in the open condition of the switch, a closed circuit is created from a condenser battery 5, serving as an energy storage source, and an inductive load 6 through the busbars 3 and the conductive electrode 1 on the one hand and the busbars 4 and the counterelectrode 2 on the other hand.

The resulting circuit is an oscillating network and, by short-circuiting the electrodes 1 and 2 together, at the first current maximum upon switching on of the condenser battery 5, it is possible to cause the current in the inductive load 6 and in the circuit in general to terminate oscillation without detrimental effect upon the condenser battery. The magnetic field thus can have a short rise time, a large retention time and a short recovery time as is desired in many of the above-mentioned magnetic field systems. The condenser battery is protected against rapid polarity reversal.

According to the invention the electrode 1 is provided with a single conventional bar of prismatic configuration, converging to a sharp edge in the direction of electrode 2. The bar 8 lies in the center of a trapezoidally shaped groove 17 in electrode 1, the groove having a mouth whose width is smaller than the width of the base of the groove.

The base of electrode 2 has an electrical contact with and carries a U-shaped aluminum plate or body 9, between the shanks of which are provided metal foils 11 above and below which are disposed insulating layers 10 which insulate the bodies of the foils from the aluminum body 9. The foils 11 may be composed of aluminum.

Figure 3:
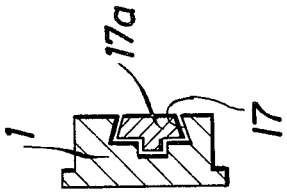
FIG. 3 is a section taken along the line III — III of FIG. 4.

The foils 11 are spaced by the insulating layers 10 on equal distances from the shanks of the aluminum U-shaped body 9, are coated with insulation as described in the aforementioned patent, and each have an edge which contacts the aluminum body 9. The cross sections of the foils 11 may increase monotonically (see FIG. 3 of the aforementioned patent) from their contact with body 9 to the other connections with a pair of high-voltage pulse sources 12.

Each of these sources comprises a small capacitor which may be charged by conventional means and, upon closing of a switch, discharges through the respective foil to cause the explosive decomposition thereof.

In addition, between the shank of the aluminum U-shaped body 9 supported by the anode electrode 2 and the lower insulating layer 10 there is provided a metal plate of high bending strength, preferably of steel, so that the force of the explosive decomposition of the fusible member 11 will be directed upwardly.

To insulate the bus bars 3 and 4 from one another and the switching electrode 1 from the upper shank of the sheet-aluminum U-shaped body 9, there is provided an insulating foil 14, preferably composed of polyethylene or a polyester.

As can be seen from FIG. 1, the prismatic bar 8 is received in a groove 17 along and above the foil 11 and formed in the switching electrode 1. This groove is of trapezoidal cross section and has a base whose width is greater than the width of the mouth of the groove. As a result the upper shank of the sheet aluminum U-shaped body 9 is clamped in the groove after the explosion of the metal foil 11.

Below the explosion zone, in the counterelectrode 2, there is provided a recess 18 in the form of an upwardly open longitudinally extending groove.

Advantageously, a hydraulic clamping device 19, e.g. a piston-and-cylinder arrangement, is provided to press the upper electrode 1 against the assembly formed by the foil 14, the aluminum U-shaped body 9, the insulating layers 10, the metal foil 11 and the counterelectrode 2.

Figure 2:
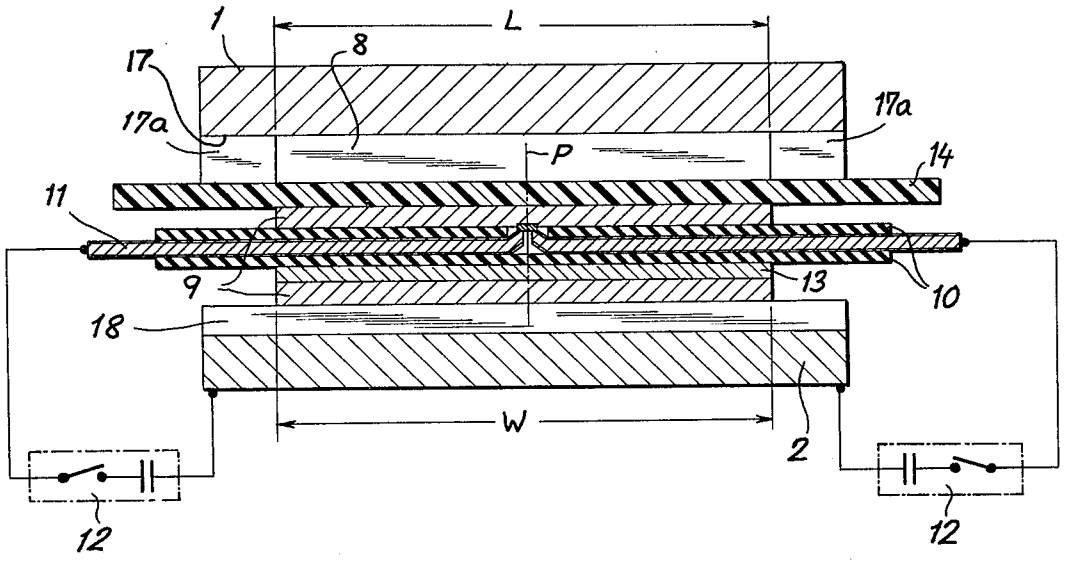
FIG. 2 is a section taken along the line II — II of FIG. 1.
Figure 4:
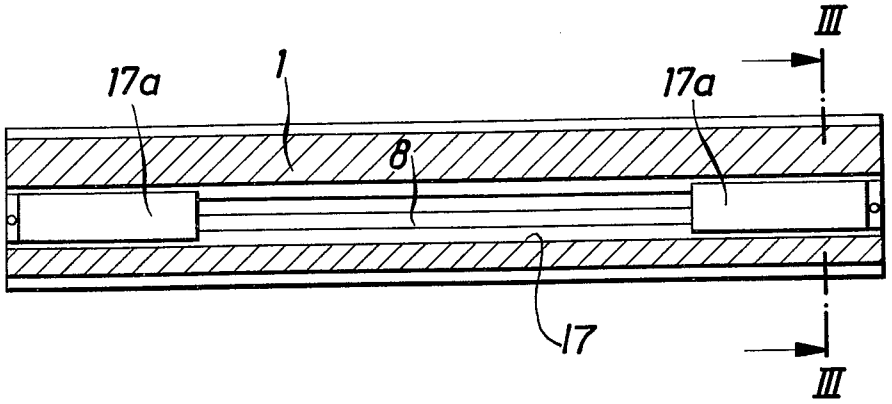
FIG. 4 is a bottom view of the switching electrode of FIG. 1, partly broken away, and illustrating the prismatic bar of the invention.

As can be seen from FIG. 4. the prismatic bar 8 is disposed within the groove 17 and has a length L (FIG. 2) corresponding to the width W of the sheet-aluminum U-shaped body 9. The portions of the groove 17 which extend to either side beyond the sheet-aluminum U-shaped body 9 are filled with bodies 17a which are of trapezoidal cross section and conform to the configuration of the groove (see FIGS. 3 and 4). These filler bodies 17*a* may be composed of nonhardened steel while bar 8 can be composed of hardened steel.

We claim:

1. In a rapid-action, high-voltage, high-current switch which comprises a switching electrode formed with a longitudinally extending groove having a mouth narrower than its base, a counterelectrode spaced from said switching electrode, a U-section sheet-aluminum body disposed between said electrodes with said first shank in contact with said counterelectrode and a second shank juxtaposed with said switching electrode, an insulating foil interposed between said second shank and said switching electrode, and means between said shanks for explosively driving said second shank into said groove to effect electrical connection between said body and said switching electrode by piercing of said insulating foil, the improvement which comprises a longitudinally extending continuous prismatic bar converging in the direction of said body to an edge adapted to penetrate said foil, said bar being disposed in said groove, said groove extending beyond said body and said bar having a length equal to the width of said second shank along said groove.

2. The improvement defined in claim 1, further comprising a filling body substantially filling said groove around said body.

3. The improvement defined in claim 2 wherein said groove extends at both ends thereof beyond said bar, a respective filling body being disposed in each of said ends of said groove.

4. The improvement defined in claim 3 wherein said filling bodies are composed of nonhardened steel.

5. The improvement defined in claim 4 wherein said electrodes are composed of nonhardened steel.

* * * * *